US008750531B2

(12) United States Patent
Delano et al.

(10) Patent No.: US 8,750,531 B2
(45) Date of Patent: Jun. 10, 2014

(54) ACTIVE NOISE CANCELLATION

(75) Inventors: Cary L. Delano, Los Altos, CA (US); Steven M. Waldstein, Scarborough, ME (US)

(73) Assignee: Fairchild Semiconductor Corporation, San Jose, CA (US)

( * ) Notice: Subject to any disclaimer, the term of this patent is extended or adjusted under 35 U.S.C. 154(b) by 398 days.

(21) Appl. No.: 12/913,897

(22) Filed: Oct. 28, 2010

(65) Prior Publication Data

US 2011/0129098 A1 Jun. 2, 2011

Related U.S. Application Data

(60) Provisional application No. 61/255,535, filed on Oct. 28, 2009.

(51) Int. Cl.

| | |
|---|---|
| ***A61F 11/06*** | (2006.01) |
| ***G10K 11/16*** | (2006.01) |
| ***H03B 29/00*** | (2006.01) |
| ***G10L 21/0216*** | (2013.01) |

(52) U.S. Cl.
CPC ... *G10L 21/0216* (2013.01); *G10L 2021/02161* (2013.01)
USPC ..... 381/71.2; 381/71.8; 379/392.01

(58) Field of Classification Search
CPC ..... G10L 2021/02161
USPC ..... 381/71.2, 71.7, 71.8; 379/392.01
See application file for complete search history.

(56) References Cited

U.S. PATENT DOCUMENTS

| | | | | |
|---|---|---|---|---|
| 4,223,181 | A * | 9/1980 | Simeau | 381/98 |
| 7,103,188 | B1 * | 9/2006 | Jones | 381/71.9 |
| 8,184,823 | B2 * | 5/2012 | Itabashi et al. | 381/74 |
| 2007/0064955 | A1 * | 3/2007 | Saito | 381/58 |

FOREIGN PATENT DOCUMENTS

| | | |
|---|---|---|
| CN | 101242677 A | 8/2008 |
| CN | 101365259 A | 2/2009 |

OTHER PUBLICATIONS

Chinese Application Serial No. 201010529715.8, Office Action mailed Sep. 4, 2013, 12 pgs.

* cited by examiner

*Primary Examiner* — Alexander Jamal
(74) *Attorney, Agent, or Firm* — Schwegman, Lundberg & Woessner P.A.

(57) ABSTRACT

This document discusses, among other things, systems and methods for active noise cancellation. One example system includes a digital ANC circuit configured to receive first audio information from a first microphone and to produce an a digital anti-noise signal configured to attenuate noise sensed by the first microphone; an analog ANC circuit configured to receive second audio information from a second microphone and to produce an analog anti-noise signal configured to attenuate noise sensed by the second microphone; and wherein the system is configured to receive an intended audio signal and to provide an output signal for a speaker using the intended audio signal, the analog anti-noise signal, and the digital anti-noise signal.

22 Claims, 13 Drawing Sheets

1100

SPEAKER LATENCY

LATENCY FROM HEADPHONE SPEAKER TO MICROPHONE PRE-AMP OUTPUT

| | 100HZ (US) | 300HZ (US) | 500HZ (US) | 1KHZ (US) |
|---|---|---|---|---|
| SENNHEISER HD280 | ~0 | 590 | 470 | 300 |
| SONY MDRV300 | ~0 | 1100 | 760 | 430 |
| SONY MDRNC22 | 1400 | 1300 | 920 | 500 |
| KEVIN'S EAR BUDS | 1900 | 1100 | 730 | 400 |
| IPOD EARD BUDS | ~0 | 950 | 730 | 400 |

ANC SET:
WAS 450US @300HZ UNDER DIFFERENT CONDITIONS: STANDING WAVE MEASUREMENT ISSUE

*THE 100HZ DATA MAY BE SUSPECT DUE TO THE MICS INABILITY TO REPRODUCE THE LOW FREQUENCY

*Fig. 11*

ACTIVE NOISE CANCELLATION

CLAIM OF PRIORITY

This patent application claims the benefit of priority, under 35 U.S.C. Section 119(e), to Delano, Cary, U.S. Provisional Patent Application Ser. No. 61/255,535 entitled "ACTIVE NOISE CANCELLATION" filed on Oct. 28, 2009, which is hereby incorporated by reference herein in its entirety.

BACKGROUND

Generally, active noise cancellation (ANC) can refer to the process of producing a sound from a speaker to attenuate noise (e.g., an unwanted sound) present in an area. To attenuate the noise, the speaker is configured to produce a sound having a similar amplitude, but opposite phase to the noise. Thus, the sound produced by the speaker will combine with and, due to the superposition of waves, reduce the amplitude of the opposite phase noise.

Generally, there are two methods of accomplishing ANC; feedback (typically analog) and feedforward (typically analog or digital). Feedback solutions include an error (e.g., near-field) microphone located near the speaker that senses the sound after the sound produced by the speaker has combined with the noise. The audio information from the error microphone is sent to a controller which then adjusts the sound produced by the speaker based thereon. In a feedforward solution, a reference (e.g., far-field) microphone senses noise before it combines with the sound produced by the speaker. The audio information from the reference microphone is sent to a controller which causes the speaker to produce a sound having a similar amplitude, but opposite phase to the noise sensed by the reference microphone. Feedforward solutions can be either fixed or adaptive, with adaptive solutions being generally more robust than fixed solutions. Various feedback or feedforward ANC solutions have been used in stereo ANC headsets.

OVERVIEW

This document discusses, among other things, systems and methods for active noise cancellation. One example system includes a digital ANC circuit configured to receive first audio information from a first microphone and to produce an a digital anti-noise signal configured to attenuate noise sensed by the first microphone, an analog ANC circuit configured to receive second audio information from a second microphone and to produce an analog anti-noise signal configured to attenuate noise sensed by the second microphone, and wherein the system is configured to receive an intended audio signal and to provide an output signal for a speaker using the intended audio signal, the analog anti-noise signal, and the digital anti-noise signal.

Example 1 includes a system for providing active noise cancellation (ANC) including a digital ANC circuit configured to receive first audio information from a first microphone and to produce an a digital anti-noise signal configured to attenuate noise sensed by the first microphone, an analog ANC circuit configured to receive second audio information from a second microphone and to produce an analog anti-noise signal configured to attenuate noise sensed by the second microphone, and wherein the system is configured to receive an intended audio signal and to provide an output signal for a speaker using the intended audio signal, the analog anti-noise signal, and the digital anti-noise signal.

In Example 2, the first microphone of Example 1 is optionally configured to sense ambient noise such that the digital ANC circuit includes a feedforward ANC circuit, and the second microphone of Example 1 is optionally configured to sense output from the speaker such that the analog ANC includes a feedback ANC circuit.

In Example 3, the digital ANC circuit of any one or more of Examples 1-2 is optionally implemented on a first integrated circuit (IC) and the analog ANC is implemented on a second IC.

In Example 4, the first IC of any one or more of Examples 1-3 is optionally configured to be coupled to an analog to digital convert (ADC) to convert the first audio information to a digital signal for the digital ANC circuit.

In Example 5, the digital ANC circuit of any one or more of Examples 1-4 is optionally configured to receive the intended audio signal and to provide a composite audio signal using the digital anti-noise signal and the intended audio signal, wherein the system includes a digital to analog converter (DAC) configured to convert the composite audio signal into an analog signal for the analog ANC circuit.

In Example 6, the digital ANC circuit and the DAC of any one or more of Examples 1-5 are optionally implemented with a field programmable gate array (FPGA).

In Example 7, the digital ANC circuit of any one or more of Examples 1-6 is optionally configured to receive first audio information from a plurality of microphones, and wherein the digital ANC circuit includes a first filter coupled to a first subset of the plurality of microphones and a second filter coupled to a second subset of the plurality of microphones.

In Example 8, each of the plurality of microphones of any one or more of Examples 1-7 optionally has a separate filter associated therewith.

In Example 9, at least one of the first filter or the second filter of any one or more of Examples 1-8 optionally includes an adaptive filter.

In Example 10, the digital ANC of any one or more of Examples 1-9 optionally use the second audio information to update a response of the first and second filters.

In Example 11, the digital ANC circuit of any one or more of Examples 1-10 is optionally configured to adjust the first filter and the second filter to provide dynamic beamsteering for a sensing pattern of the first and second microphone.

In Example 12, the speaker of any one or more of Examples 1-11 optionally includes a piezoelectric speaker.

In Example 13, the speaker of any one or more of Examples 1-12 optionally includes a first piezoelectric speaker and a second dynamic speaker.

Example 14 includes a method for providing active noise cancellation (ANC) including receiving first audio information from a first microphone and providing first ANC information using an analog ANC circuit, receiving second audio information from a second microphone and providing second ANC information using a digital ANC circuit, and providing a combined ANC signal using the first and second ANC information.

In Example 15, the subject matter of any one or more of Examples 1-14 optionally includes combining an intended audio signal with the first ANC information and the second ANC information to produce an output signal for a speaker.

In Example 16, the combining of any one or more of Examples 1-15 optionally includes combining the intended audio signal with the second ANC information to form a composite audio signal, and combining the composite audio signal with the first ANC information to produce the output signal.

In Example 17, the first audio information of any one or more of Examples 1-16 is optionally sensed by a first microphone configured to sense output from the speaker, and the second audio information of any one or more of Examples 1-16 is optionally sensed by a second microphone configured to sense ambient noise.

In Example 18, the subject matter of any one or more of Examples 1-17 optionally includes adaptively filtering the second audio information.

In Example 19, the adaptively filtering of any one or more of Examples 1-18 optionally includes updating a filter response based on the first audio information.

In Example 20, the receiving second audio information of any one or more of Examples 1-19 optionally includes receiving second audio information from a plurality of microphones wherein the method includes: filtering a first signal from a third microphone of the plurality of microphones using a first filter, and filtering a second signal from a fourth microphone of the plurality of microphones using a second filter.

In Example 21, the subject matter of any one or more of Examples 1-20 optionally includes adjusting the first filter and the second filter to provide dynamic beamsteering for a sensing pattern of the third and fourth microphone.

Example 22 includes a system for providing active noise cancellation (ANC) including a digital ANC circuit configured to receive first audio information from a first microphone and to produce an anti-noise signal configured to attenuate noise in the first audio information, a summation circuit configured to combine the anti-noise signal from the digital ANC circuit with an intended audio signal to form a composite audio signal, and an analog ANC circuit configured to receive second audio information from a second microphone and the composite audio signal, the analog ANC circuit configured to attenuate noise in the second audio information and to produce an output signal for a speaker based on the second audio information and the composite audio signal.

In Example 23, the digital ANC circuit of any one or more of Examples 1-22 is optionally configured to receive third audio information from a third microphone, the first and third microphones configured to sense ambient noise, to adaptively filter the first audio information with a first filter, and to adaptively filter the third audio information with a second filter, wherein the anti-noise signal is configured to attenuate noise in the third audio information.

In Example 24, the digital ANC circuit of any one or more of Examples 1-23 is optionally configured to dynamically adjust the first filter and the second filter to provide dynamic beamsteering for a sensing pattern of the first and second microphones.

In Example 25, a system or method can include, or can optionally be combined with any portion or combination of any portions of any one or more of Examples 1-24 to include, means for performing any one or more of the functions of Examples 1-24, or a machine-readable medium including instructions that, when performed by a machine, cause the machine to perform any one or more of the functions of Examples 1-24.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

FIG. 11 illustrates generally examples of various speaker latency.

DETAILED DESCRIPTION

The present inventors have recognized, among other things, that both feedback and feedforward active noise cancellation (ANC) can be combined in a single solution. In an example, the combined feedback and feedforward solution can be specifically designed for or used in a mobile phone application.

Figure 1:
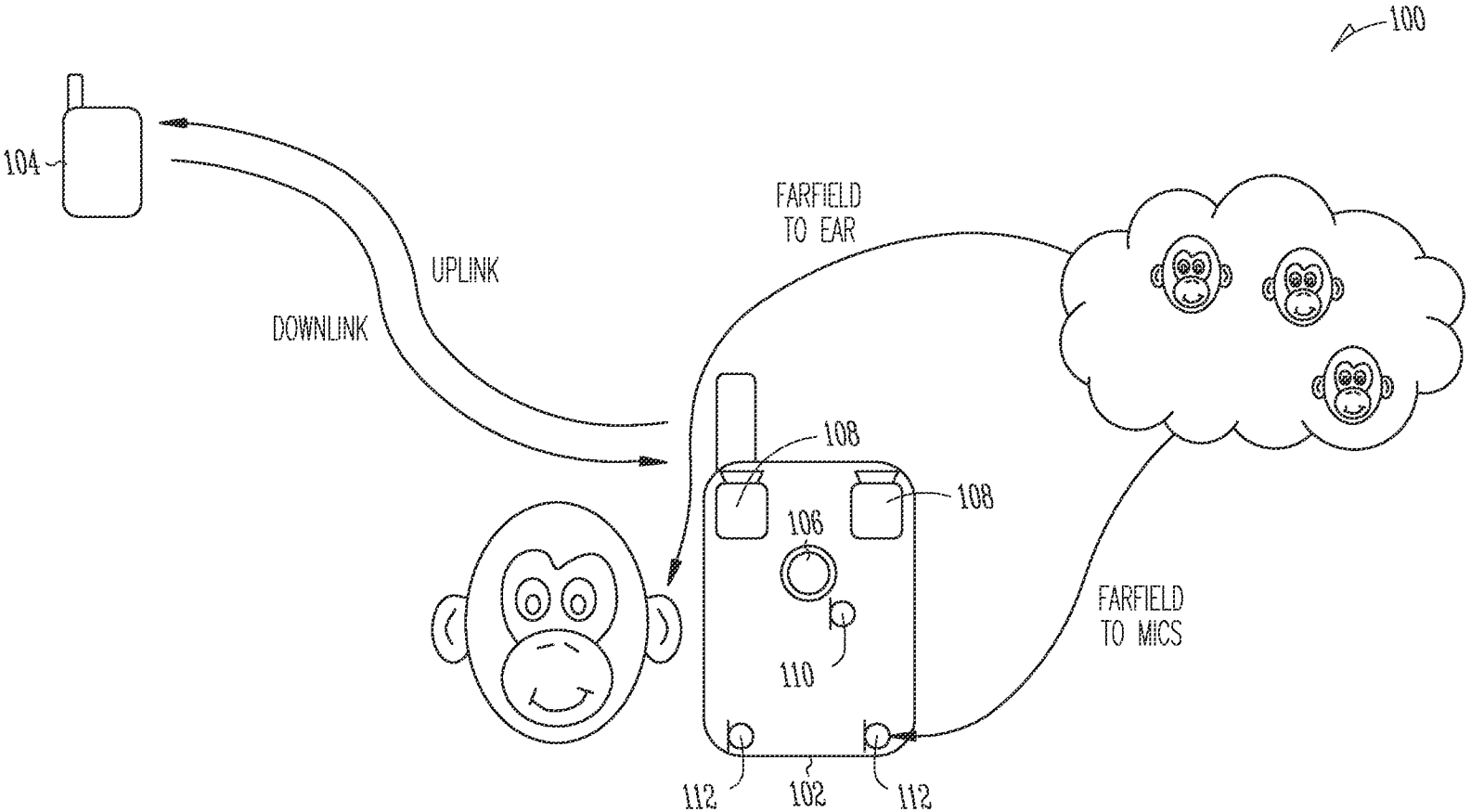
FIG. 1 illustrates generally an example block diagram of a communication system.

FIG. 1 illustrates generally an example block diagram of a communication system 100. The communication system 100 can include a first mobile phone 102 configured to communicate (e.g., wirelessly) with a second mobile phone 104. The first mobile phone 102 can send audio information (e.g., uplink) to the second mobile phone 104 and receive audio information (e.g., downlink) from the second mobile phone. The downlink audio information received by the first mobile phone 102 can be produced by one or more speakers 106, 108 on the first mobile phone 102. In an example, the first mobile phone 102 can include one or more short range speakers 106 configured to be located near an ear of a user (e.g., when a user is holding the first mobile phone 102 up to their ear); and one or more long range speakers 108 configured to be located away from an ear of a user (e.g., when a user is using the first mobile phone 102 in speakerphone mode).

The first mobile phone 102 can also include a plurality of microphones 110, 112 for sensing sounds and producing audio information regarding the sensed sounds. The microphones 110, 112 can include directional microphones or omni-directional microphones. In an example, the first mobile phone 102 includes one or more near-field microphones 110 configured to sense output from the short range speaker 106. Accordingly, in an example, the near-field microphone 110 is located near the short range speaker 106. Typically, during use of the short range speaker 106, the first mobile phone 102 will be pressed up against the user or very close to the user such that the short range speaker 106 produces sound in a semi-enclosed area. In an example, the near-field microphone 110 is located within the semi-enclosed area in order to sense the combination of the sound produced by the speaker and noise as heard by the ear of the user. The first mobile phone 102 can also include one or more far-field microphones 112 configured to sense ambient noise (e.g., far-field sounds). Accordingly, in an example, the far-field microphones 112 can be located away from the speakers 106, 108 in order to sense the ambient noise while reducing the amount of sound sensed from the speakers 106, 108.

Figure 2:
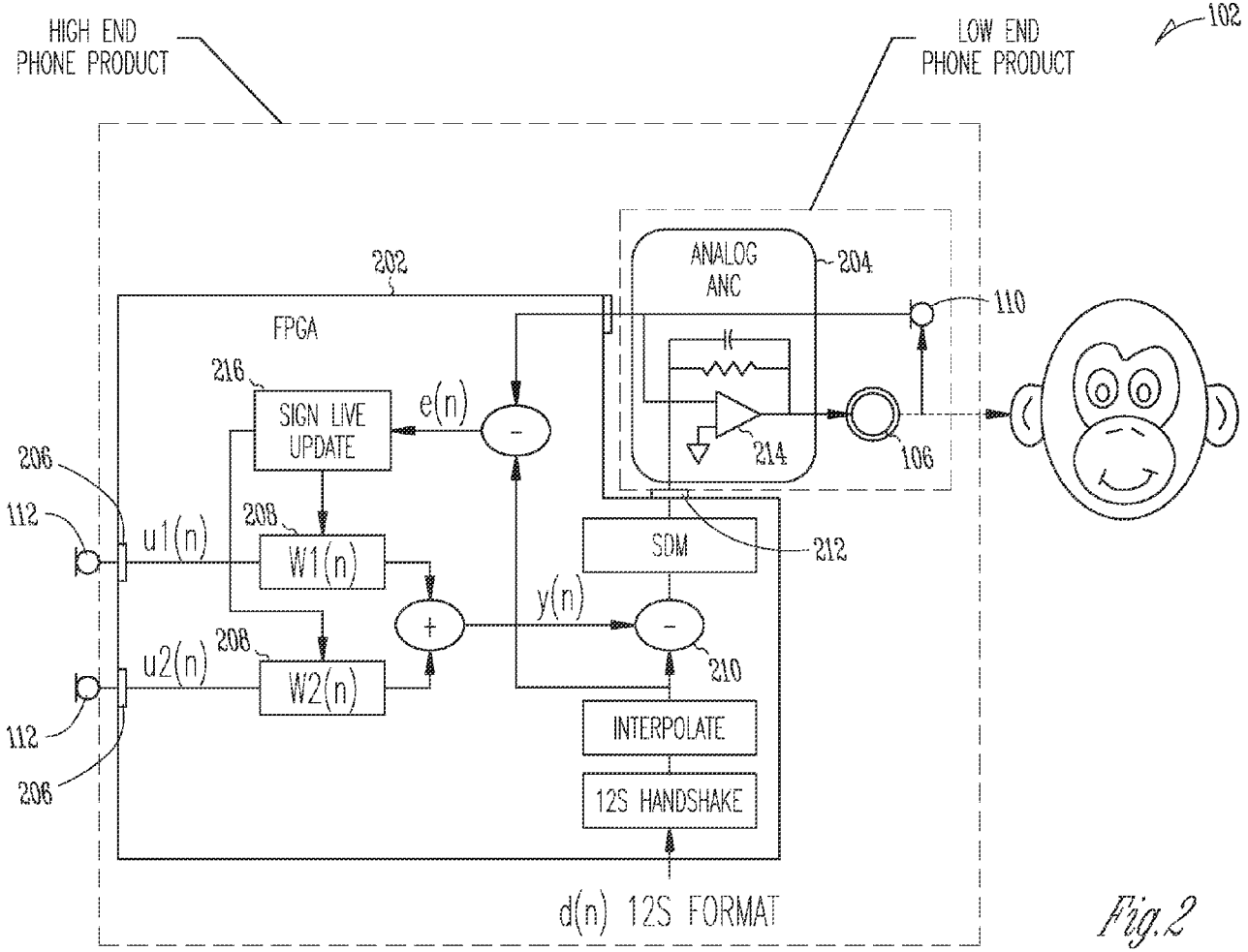
FIG. 2 illustrates generally an example block diagram of an active noise cancellation (ANC) system of the mobile phone that uses both feedback and feedforward methods of ANC.

FIG. 2 illustrates generally an example block diagram of an ANC system 200 of the mobile phone 102 that uses both feedback and feedforward methods of ANC. As mentioned with respect to FIG. 1, the mobile phone 102 can include a short range speaker 106 having a near-field microphone 110 located nearby. The mobile phone 102 can also include two far-field microphones 112 located away from the speaker 106. In an example, the ANC system includes a digital ANC circuit 202 and an analog ANC circuit 204. In an example, the digital ANC circuit 202 performs ANC on digital (e.g., high (1) and low (0) bits) audio information and the analog ANC circuit 204 performs ANC on analog (e.g., a waveform) audio information. In an example, the analog ANC circuit 204 performs a feedback method of ANC using audio information from the near-field microphone 110. The digital ANC circuit 202 performs a feedforward method of ANC using audio information from the far-field microphones 112. In an example, the digital ANC circuit 202 also uses audio information from the near-field microphone 110 as discussed in more detail below.

The ANC system combines the output from the digital ANC circuit 202, the output from the analog ANC circuit 204, and an intended audio signal to produce an output for the speaker 106. The intended audio signal includes a signal for which the user is intended to hear (e.g., audio information received from the second mobile phone 104). The intended audio signal is included with an anti-noise (e.g., intended to attenuate noise) signal from the digital ANC circuit 202 and an anti-noise signal from the analog ANC circuit 204 to produce the output for the speaker 106.

The digital ANC circuit 202 receives audio information from the far-field speakers 112 to perform feedforward ANC. In an example, the audio information from the speakers 112 is converted from analog to digital with an analog to digital converter (ADC) 206. The digital audio information from the ADC 206 is filtered with a filter 208. FIG. 2 illustrates two far-field microphones 112; however in other examples, one or more than two far-field microphones 112 can be used. Moreover, FIG. 2 illustrates two filters 208 (w1(n) and w2(n)), one for each microphone 112; however in other examples one or more than two filters 208 can be used and a single filter 208 can be coupled to more than one microphone 112. In any case, when multiple filters 208 are present, the output from the filters 208 is combined to form a digital anti-noise signal. The digital anti-noise signal is configured to produce a sound from the speaker 106 to attenuate the noise sensed by the far-field microphones 112.

In an example, the digital anti-noise signal is combined with the intended audio signal using a summation circuit 210. In an example, the intended audio signal comprises a digital signal and, as such, is digitally combined with the digital anti-noise signal in the summation circuit 210. In an example, the digital anti-noise signal comprises an accurate representation of the noise (e.g., all sound minus the sound from speakers 106, 108) sensed by the far-field microphones 112 and, as such, the digital anti-noise signal is subtracted from (e.g., inverted and combined with) the intended audio signal. The combination of the digital anti-noise signal and the intended audio signal is referred to herein as a composite audio signal.

In an example, the composite audio signal is converted to an analog form with a digital to analog converted (DAC) 212. The analog composite audio signal is sent to the analog ANC circuit 204. Along with the analog composite audio signal, the analog ANC circuit 204 receives audio information from the near-field speaker 110. The analog ANC circuit 204 forms an analog anti-noise signal using a feedback loop with one or more amplifiers 214. The analog anti-noise signal is configured to produce a sound from the speaker 106 to attenuate the noise sensed by the near-field microphone 112. The analog ANC circuit 204 combines the analog anti-noise signal with the composite audio signal received from the digital ANC circuit 202 to produce an output signal for the speaker 106. Accordingly, the output signal configures the speaker 106 to produce sound corresponding to the intended audio signal as well as sound intended to attenuate noise based on a feedforward method (the digital ANC circuit 202) and a feedback method (the analog ANC circuit 204) of ANC.

In an example, the analog ANC circuit 202 can be less expensive to implement than the combination of the digital ANC circuit 202 and the analog ANC circuit 204, but the combination of the digital ANC circuit 202 and the analog ANC circuit 204 can produce better overall noise cancellation. Accordingly, in an example, the ANC system shown in FIG. 2 can be implemented on two separate integrated circuits (ICs) with the analog ANC circuit 204 on a first IC and the digital ANC circuit 202 on a second IC. Thus, a high end product can use both the first IC and the second IC to implement the combination of the analog ANC circuit 204 and the digital ANC circuit 202, while a low end product can use the first IC without the second IC to implement only the analog ANC circuit 204.

Additionally, in an example, the one or more ADCs 206 for converting the audio information from the far-field speakers 112 into digital form are separate from the second IC which includes the digital ANC circuit 202. For example, when the microphones 112 comprise digital microphones, the ADCs 206 can be integrated into a separate IC from the second IC. Accordingly, the ADCs 206 can be physically located away from the amplifier 214 for the analog ANC circuit 204. In another example, the ADCs 206 are integrated on the second IC when the microphones 112 comprise analog microphones.

In an example, the ADCs 206 can comprise Sigma-Delta ADCs. Using Sigma-Delta ADCs can reduce system latency and simplify the adaptive filters 208. For example, when using Sigma-Delta ADCs, the adaptive filters 208 can comprise 1-bit multipliers (PDM output) instead of 24 bit. Use of 1-bit multipliers, however, can increase the number of taps for the filters 208. In examples where speaker 106 comprises a dynamic speaker, the latency of speaker 106 can dominate overall system latency. Accordingly, in an example, the speaker 106 can include a piezoelectric speaker to reduce the latency thereof. In yet another example, the speaker 106 can include a piezoelectric speaker and a dynamic speaker (hybrid solution) to reduce latency and provide a good sound response.

In an example, additional filtering for each microphone 112 individually or in combination can be provided after the adaptive filters 208 (e.g., to remove out of band (OOB) noise).

In an example, the digital ANC circuit 202 is implemented with a field programmable gate array (FPGA). Finally, as mentioned above, the digital ANC circuit 202 can use the audio information from the near-field microphone 110 combined with a copy of the intended audio signal to update a response of the filters 208 using a filter response controller 216. More detail regarding the filter response controller 216 is provided below.

Figure 3:
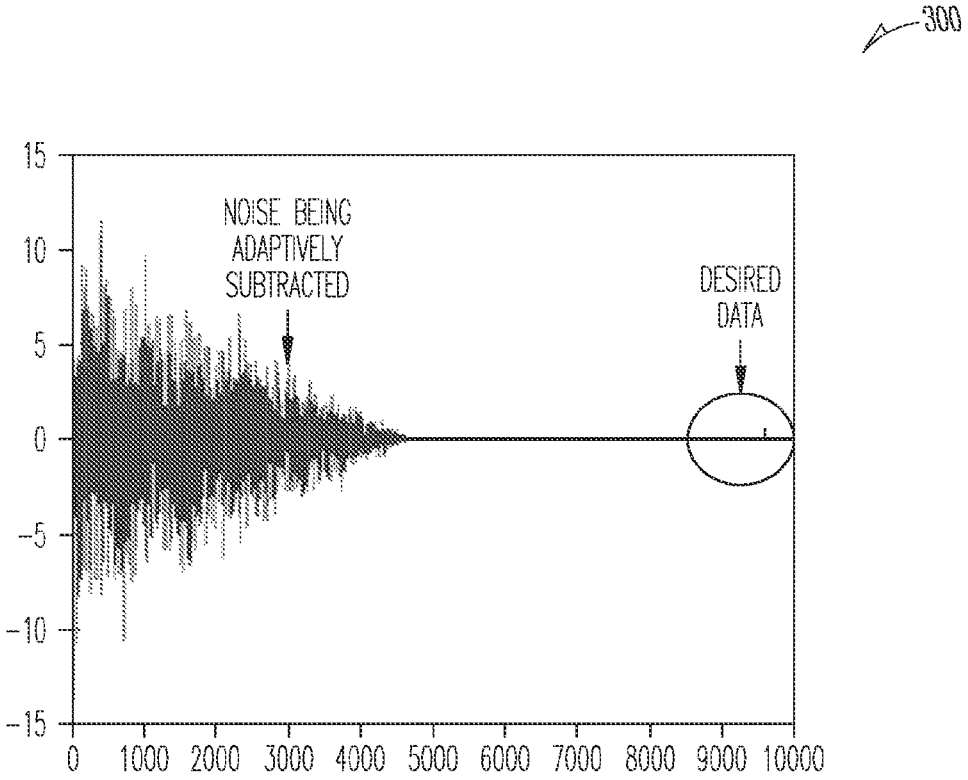
FIG. 3 illustrates generally an example of an audio signal having noise being adaptively subtracted and the resulting desired data.

In an example, the filters 208 for the digital ANC circuit 202 include adaptive filters that adjust to the noise over time. FIG. 3 illustrates generally an example of an audio signal 300 having noise being adaptively subtracted and the resulting desired data.

As discussed above, the ANC system of FIG. 2 includes a combination of the digital ANC circuit 202 implementing a feedforward method and the analog ANC circuit 204 implementing a feedback method. This combination can utilize the strengths of both ANC circuits while compensating for the weaknesses of each.

Figure 4:
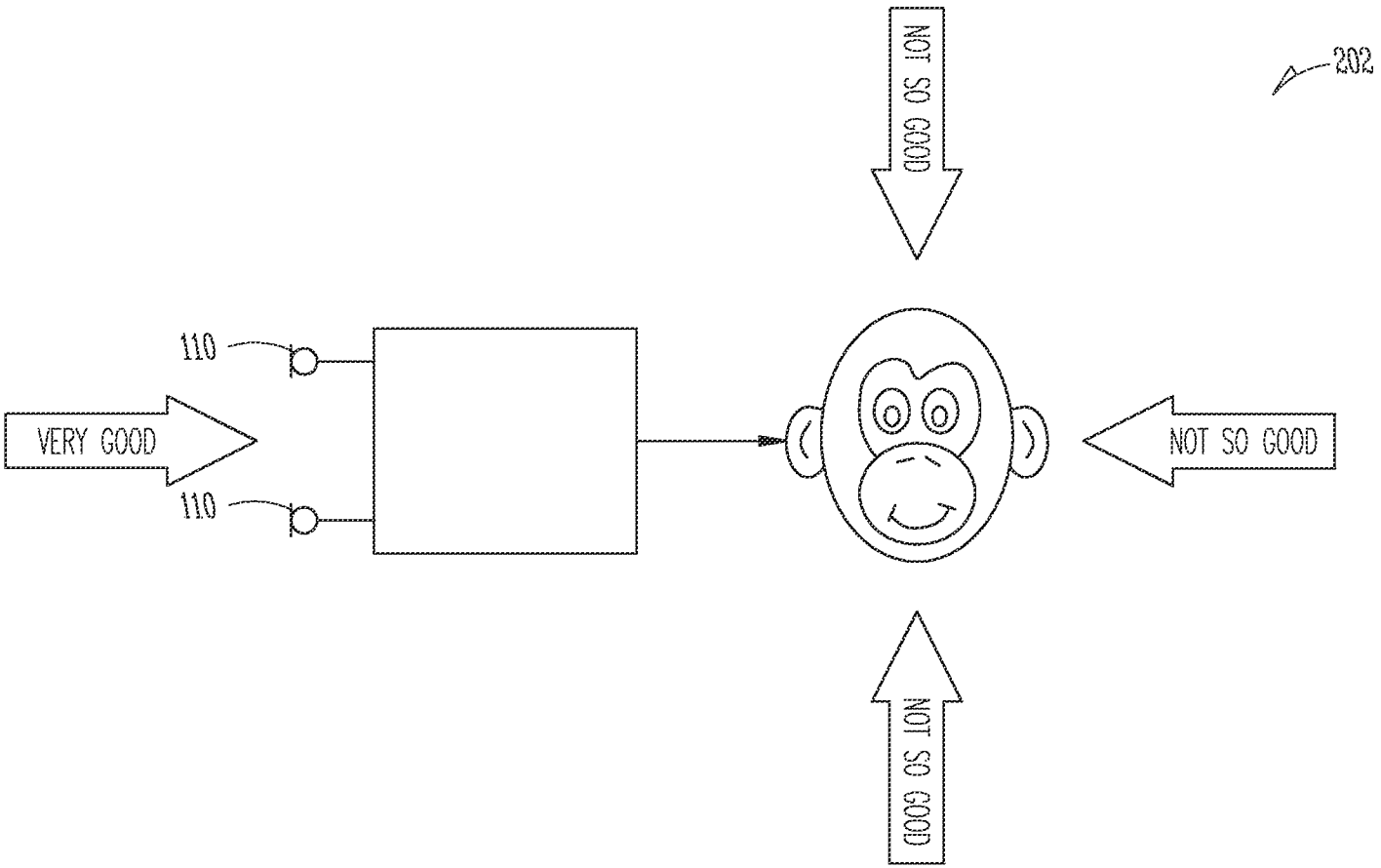
FIG. 4 illustrates generally an example of the directional strengths and weaknesses of a digital ANC circuit implementing a feedforward method of ANC.

FIG. 4 illustrates generally an example of the directional strengths and weaknesses of a digital ANC circuit 202 implementing a feedforward method of ANC. As shown, a digital ANC circuit 202 provides different ANC abilities depending on the direction of the noise being attenuated. For example, when the noise arrives on a path directed perpendicular to a line connecting two far-field microphones 112 noise can be attenuated very well by the digital ANC circuit 202. Without adjustable microphone responses, however, the farther the noise strays from this direction, however, the less effective the digital ANC circuit 202 is at attenuating that noise.

Combining the digital ANC circuit 202 and the analog ANC circuit 204, however, can negate the weaknesses of both approaches. For example, the analog ANC circuit 204 implementing a feedback method of ANC can provide decent noise attenuation regardless of the direction of the noise, but the noise attenuation is not as good as the noise attenuation provided by the digital ANC circuit 202 in the very good direction. Accordingly, the combination of the digital ANC circuit 202 and the analog ANC circuit 204 can provide good noise attenuation in most directions and fantastic noise attenuation in directions aligning with a far-field microphone 112 as discussed above. Additionally, in certain examples, the digital ANC circuit 202 can adapt out the interference of the analog ANC circuit 204, and the analog ANC circuit 204 can alleviate performance requirements from digital ANC circuit 202, allowing for more digital for the FPGA.

Figure 5:
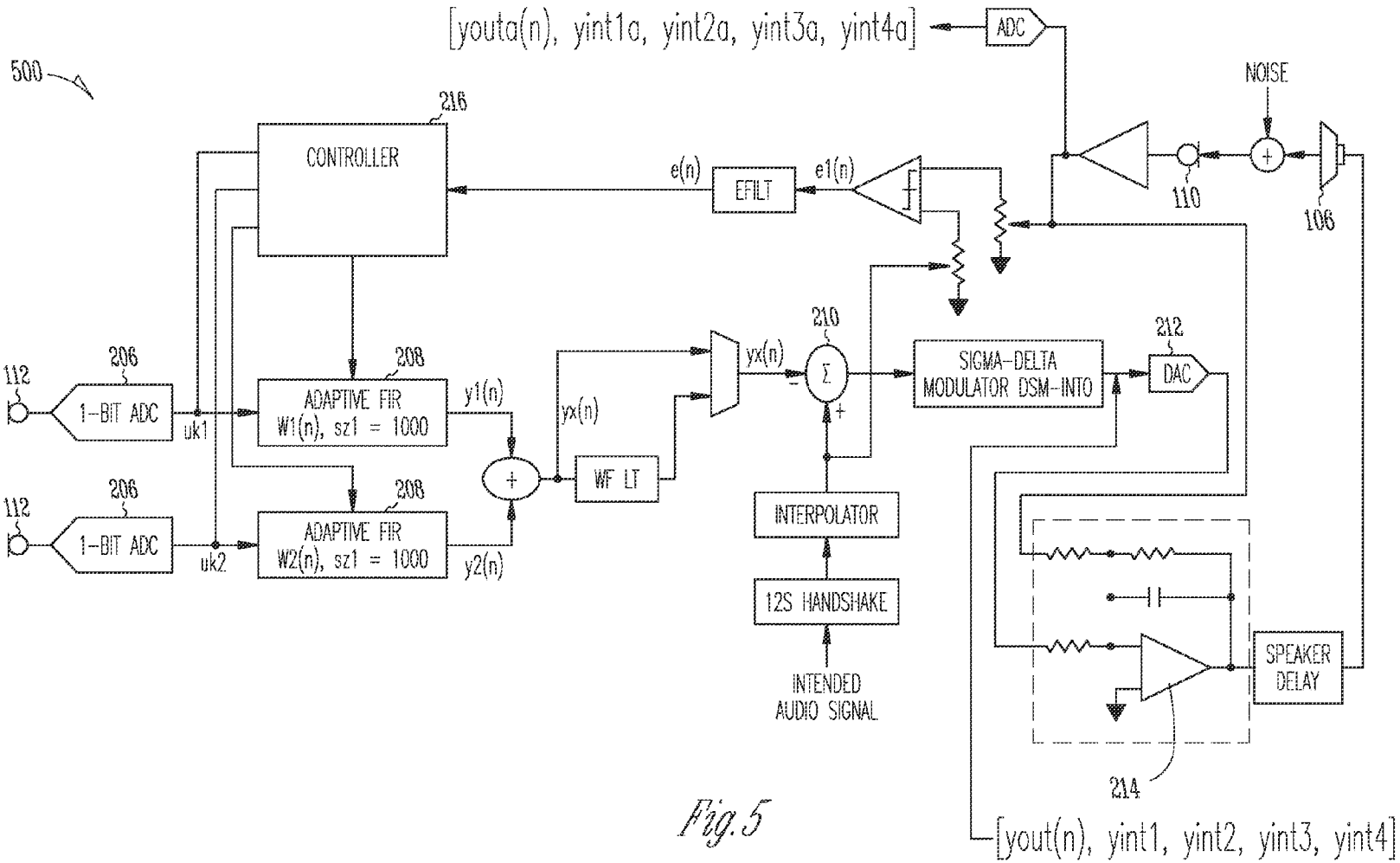
FIG. 5 illustrates generally an example of an ANC system.

FIG. 5 illustrates generally an example of an ANC system 500. The ANC system 500 includes the components discussed with respect to FIG. 2 above. As shown, the ANC system 500 includes two far-field microphones 112. Using two far-field microphones provides a directional response for the digital ANC circuit 202. Additionally, as shown in FIG. 5, a separate adaptive filter 208 is used for each microphone 112. Separate adaptive filters 208 enables the directional response for the digital ANC circuit to be steered (e.g., using beamsteering) to accomplish better ANC. In an example the filters 208 can be dynamically adjusted to provide dynamic beamsteering for the microphones 112. In an example, the filters 208 can be adjusted to avoid steering a null into a desired signal (e.g., noise reception) path.

Figure 6:
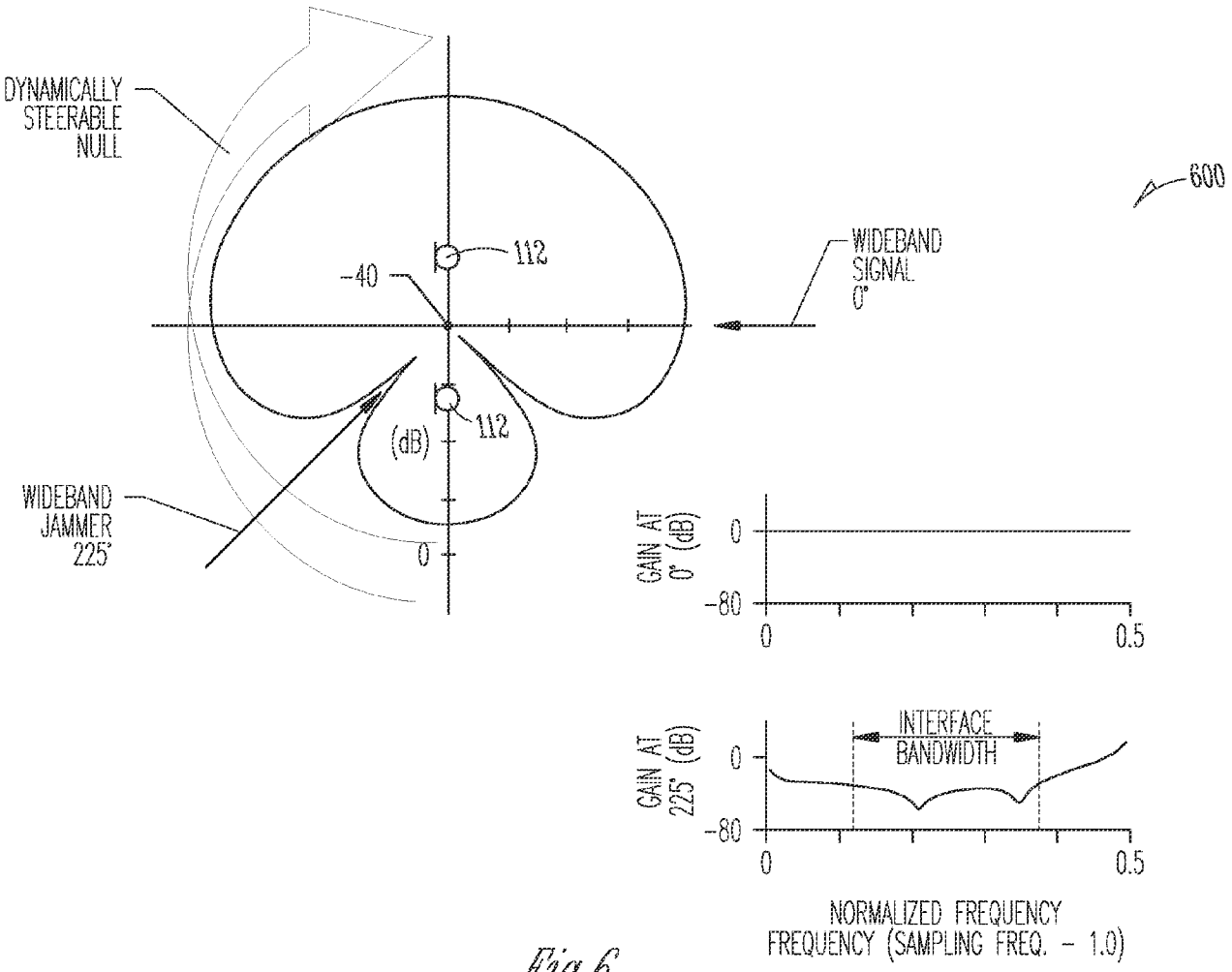
FIG. 6 illustrates generally an example of a response for two far-field microphones.

FIG. 6 illustrates generally an example of a response 600 for two far-field microphones 112. As shown, the response 600 includes two nulls. Accordingly, by adjusting the filters 208, the nulls can be steered to an appropriate direction. In an example, without the beamsteering capability (e.g., having when two microphones are coupled (tied) together), the nulls would exist and be unavoidable. However, with steering, the nulls can be managed or avoided.

Figure 7:
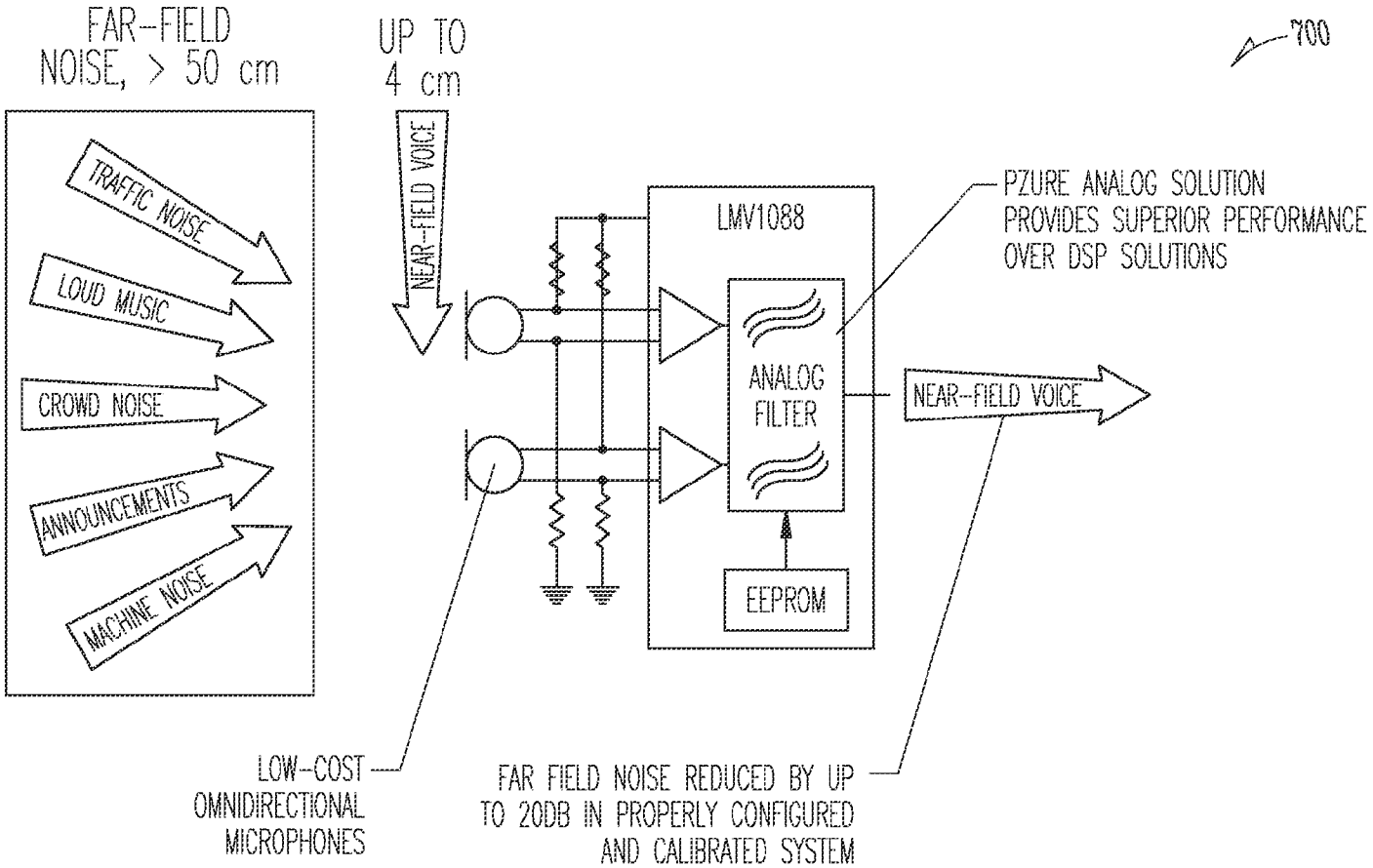
FIG. 7 illustrates generally an example of a far-field noise suppression microphone amplifier.

FIG. 7 illustrates generally an example of a far-field noise suppression microphone amplifier 700. In the example of FIG. 7, the microphone amplifier 700 is a pure analog solution, where sensitive analog microphone signals must traverse noteworthy PCB distances to reach chip and therefore risk noise pickup. Correct microphone separation can be important for optimal beamsteering, and the noteworthy PCB distances can be problematic.

Figure 8:
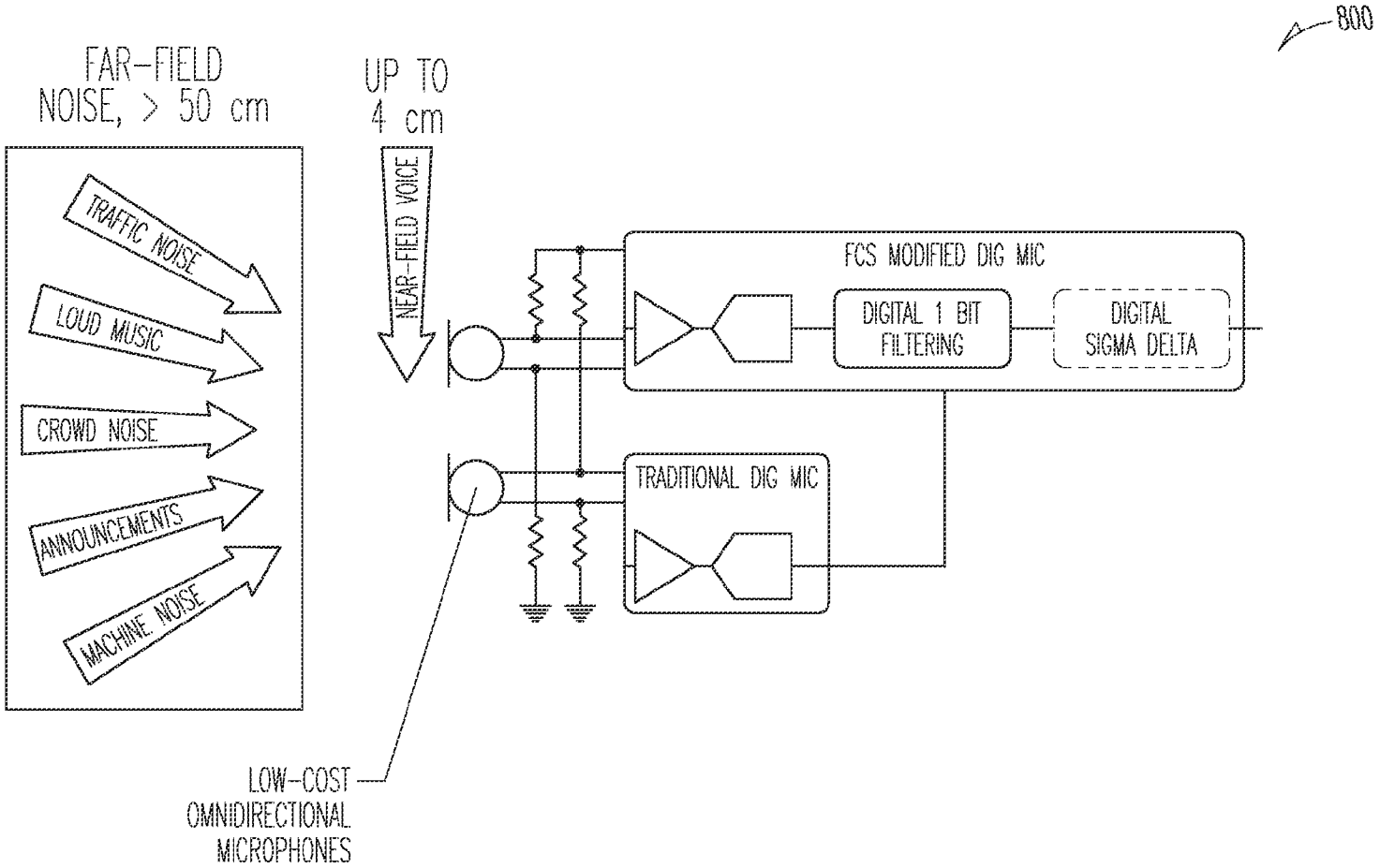
FIG. 8 illustrates generally an example of a digital far-field microphone amplifier solution.

FIG. 8 illustrates generally an example of a digital far-field microphone amplifier solution 800. In an example, the digital amplifier solution 800 can be configured to provide beamsteering of digital microphones to optimize nearfield over farfield in digital microphone ICs using digital handshaking between the digital microphones. In an example, the predecimation signal can have a high bandwidth and the results can be as good as an analog signal. Further, the digital amplifier solution 800 can resolve the problem of routing sensitive analog microphone signals to a single chip by managing issues digitally before bandwidth limiting decimation. The digital filters can allow wideband nulls and adaptation.

Figure 9:
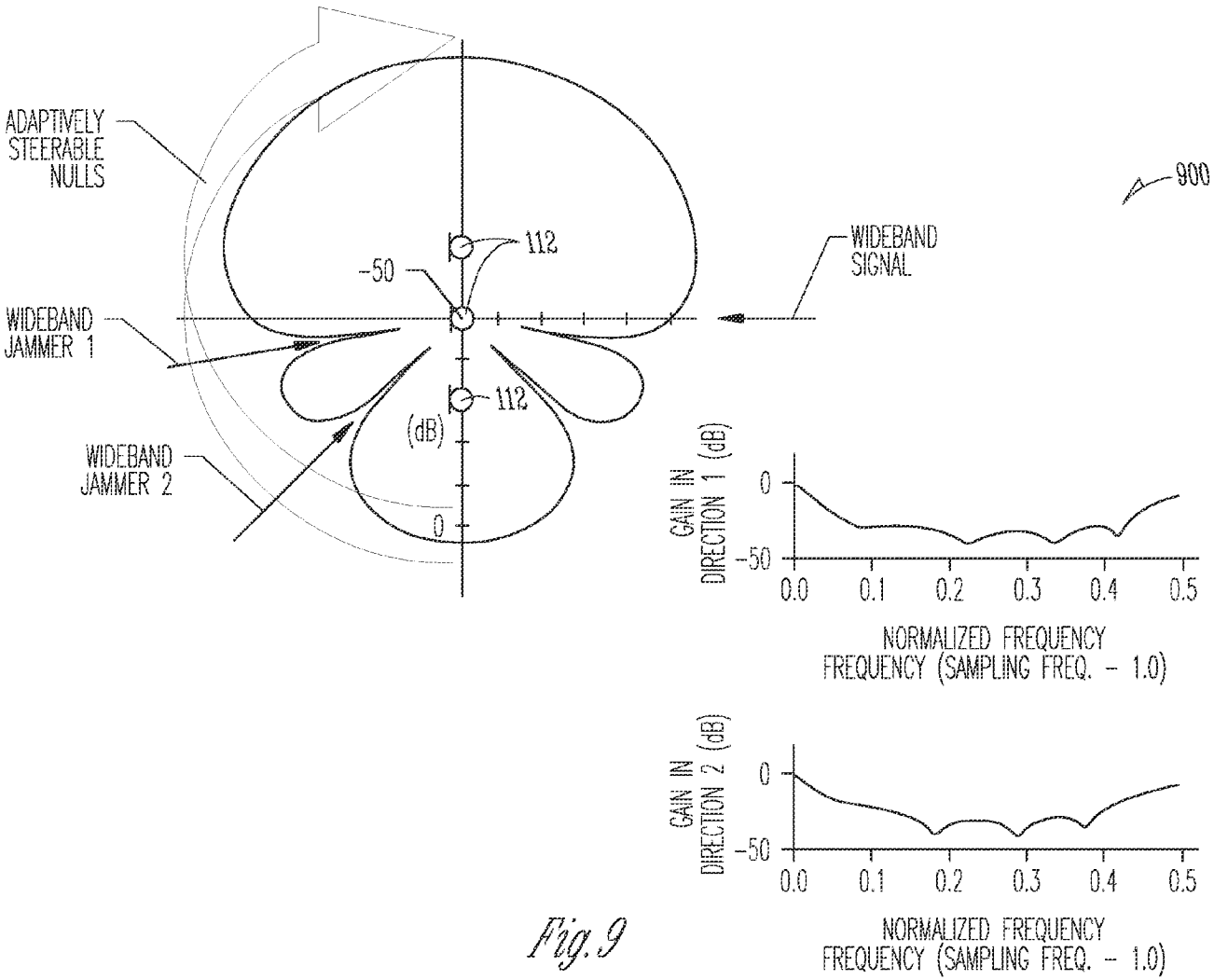
FIG. 9 illustrates generally an example of a response for three far-field microphones.

FIG. 9 illustrates generally an example of a response 900 for three far-field microphones 112. As shown, with additional far-field microphones 112, the depth of the nulls are reduced, but there are additional nulls to consider when beamsteering the response.

In an example, the combined feedback and feedforward ANC solution can be used with speakerphone using an extra "cone of silence" microphone (e.g., 3 usable position locations). Further, the beamsteering three microphones can produce smaller lobes to better select a speaker. In an example, the combined feedback and feedforward ANC solution can require a threshold detection to avoid dialing into undesired sources during speaking silence, or can suppress farfield noise using a notch response when a lobe is not pointing to a source.

In an example, the audio information from the near-field microphone 110 is provided to the filter response controller 216 to update the response of the filters 208. In an example, the response of the filters 208 is updated using a least mean squared (LMS) method that updates a sign of the response.

Figure 10:
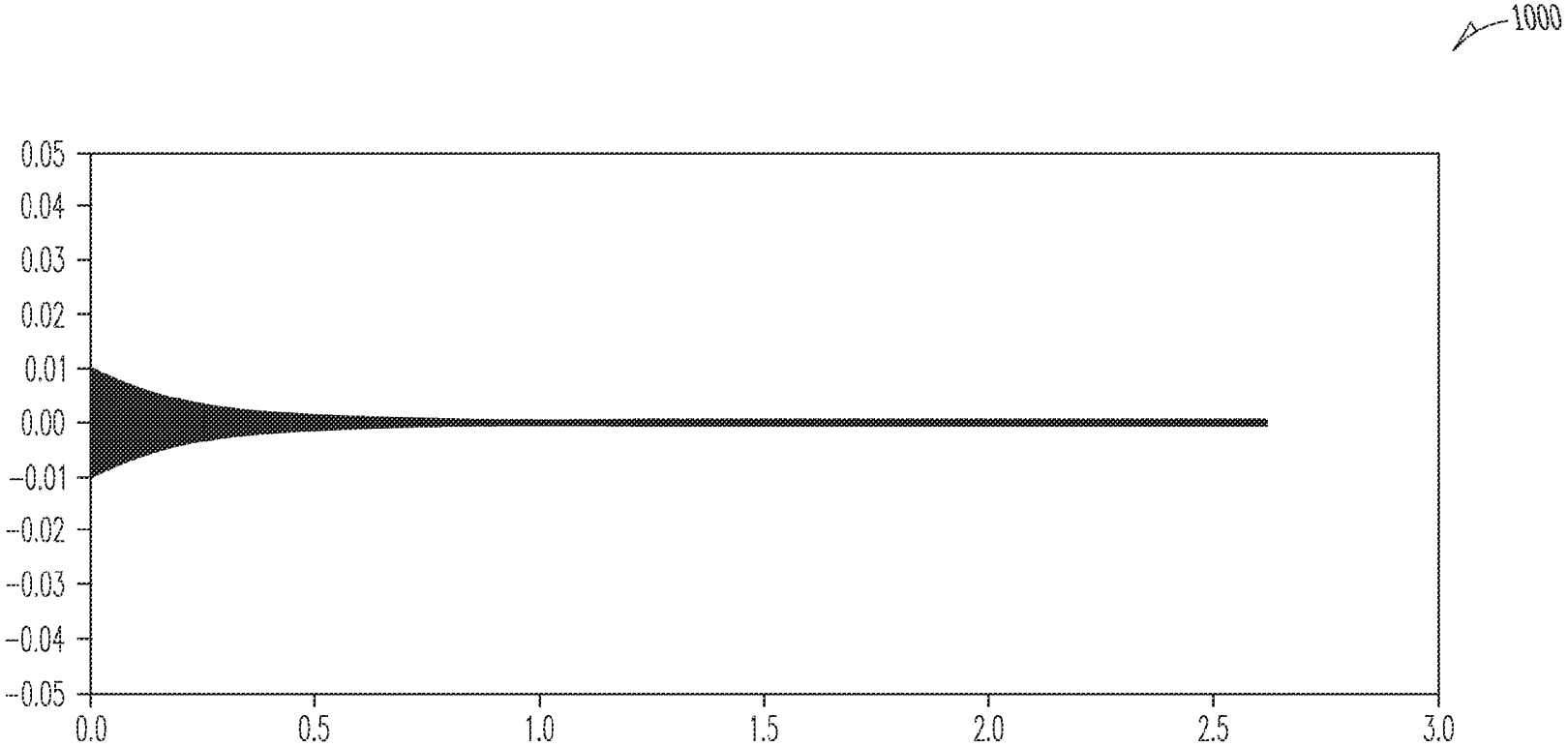
FIG. 10 illustrates generally an example of an audio signal having noise being adaptively removed and resulting desired data.

FIG. 10 illustrates generally an example of an audio signal 1000 having noise being adaptively removed by the ANC system 500 and showing the resulting desired data. Here, by adjusting mu, a least means square (LMS) parameter in Matlab, >30 dB rejection can be achieved at a high frequency. In the example of FIG. 10, the e(n) signal is being filtered, making the adaptive filter focus on the in-band energy and ignore the feedback ADC OOB energy without adding a full decimator, emphasizing the adaptive results in the correct area.

In certain examples, without using a decimation filter, the OOB noise from the microphone ADCs can be monitored. Because the noise is OOB, it is not audible, but it can increase power dissipation in the output amp and speaker. A good target is 1% of full scale for this residual energy. In an example, a traditional decimation filter can be overkill, as the adaptive filter can remove a good deal of this energy, in certain examples, virtually all of it right after a good initialization. But as the filter adapts, it can become less effective in this area due to the e(n) filter making it ignore the OOB energy. In an example, a simple filter can be added after the summing of W1(n) and W2(n), in certain examples, with less delay than a decimator. Further, the DAC DSM and DAC filtering can add significant filtering, but the DAC can re-add residual OOB noise, and in certain examples, the DAC DSM can be overloaded by OOB energy and increase the requirements on the DAC DSM filter.

In an example, an LMS algorithm can accommodate speaker latency using a parameter (est_speaker_delay) to accommodate a large range of speaker latencies. In certain examples, an e(n) filter can equalize out the speaker group delay variation, or a simple time delay can be used.

In an example, the LMS algorithm can include the sign-error-LMS algorithm, using the sign of the error signal instead the full error signal (e.g., to simplify computation). In an example, if the data is in a 1-bit format, the sign-data can be redundant. In certain examples, variations on the sign-LMS algorithm can increase residual adaptation energy, which can be compensated by shrinking mu and increasing adaptation time (e.g., saving die area and power).

In an example, the mu parameter can be updated either by I2C or by looking at the e(n) residual energy. In other examples, both (plus a hybrid version) can be supported.

In certain examples, a field programmable gate array (FPGA) can be configured to use a feedback ADC or work without one because of the simple sign-error algorithm. In an example, the intended audio signal can be subtracted on the board to work without the feedback ADC. Further, in an example, an ANC solution can use AGC circuitry instead of trim pots.

In other examples, additional adaptive filters (e.g., beyond 2) can be added in the code (e.g., by replicating the code from one to two filters). The LMS algorithm can provide the beam-steering work by adapting to provide a minimum mean square error (MMSE). In an example, a high end solution can use that algorithm.

Further, in certain examples, different W1(n) and W2(n) initializations can be used. There are sufficient taps to produce a very sharp filter, although the sharp filter can have a large natural latency. If the taps were utilized in place of decimation filters, the very sharp filter can loose response during times of silence.

In certain examples, adaptive algorithms can be turned off during times of silence (e.g., by monitoring the energy on the outputs of W1(n) and W2(n) and to zero out mu when there is low signal energy) to ensure that the LMS algorithm does not drift or adapt to undesired parameters during the times of silence.

FIG. 11 illustrates generally examples of various speaker latency 1100.

Figure 12:
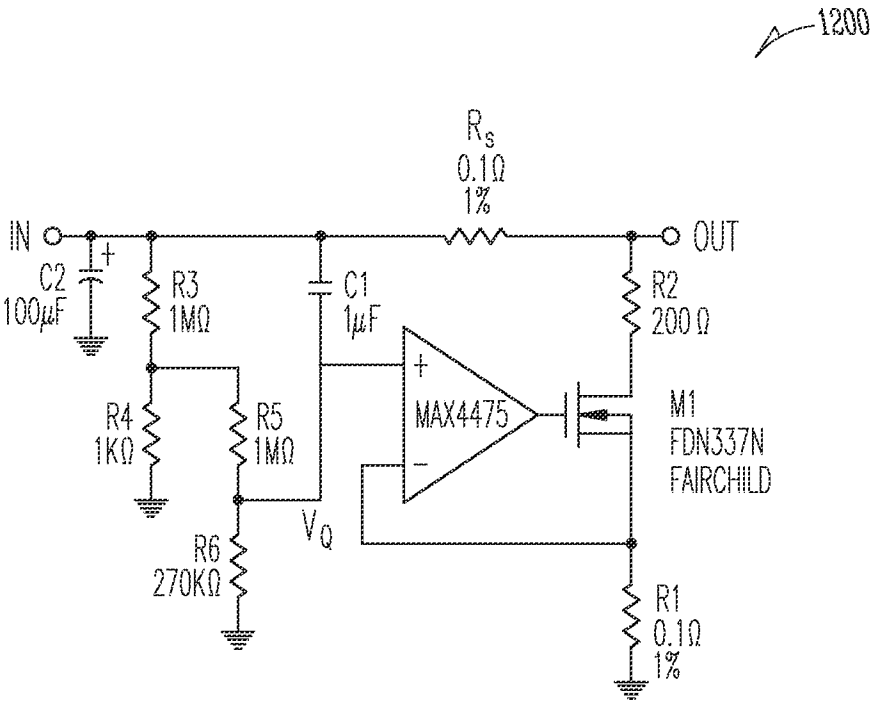
FIG. 12 illustrates generally an example of another analog ANC circuit for use in an ANC system.
Figure 12:
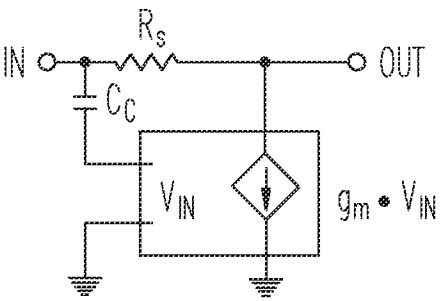

FIG. 12 illustrates generally an example of another analog ANC circuit 1200 for use in an ANC system.

Figure 13:
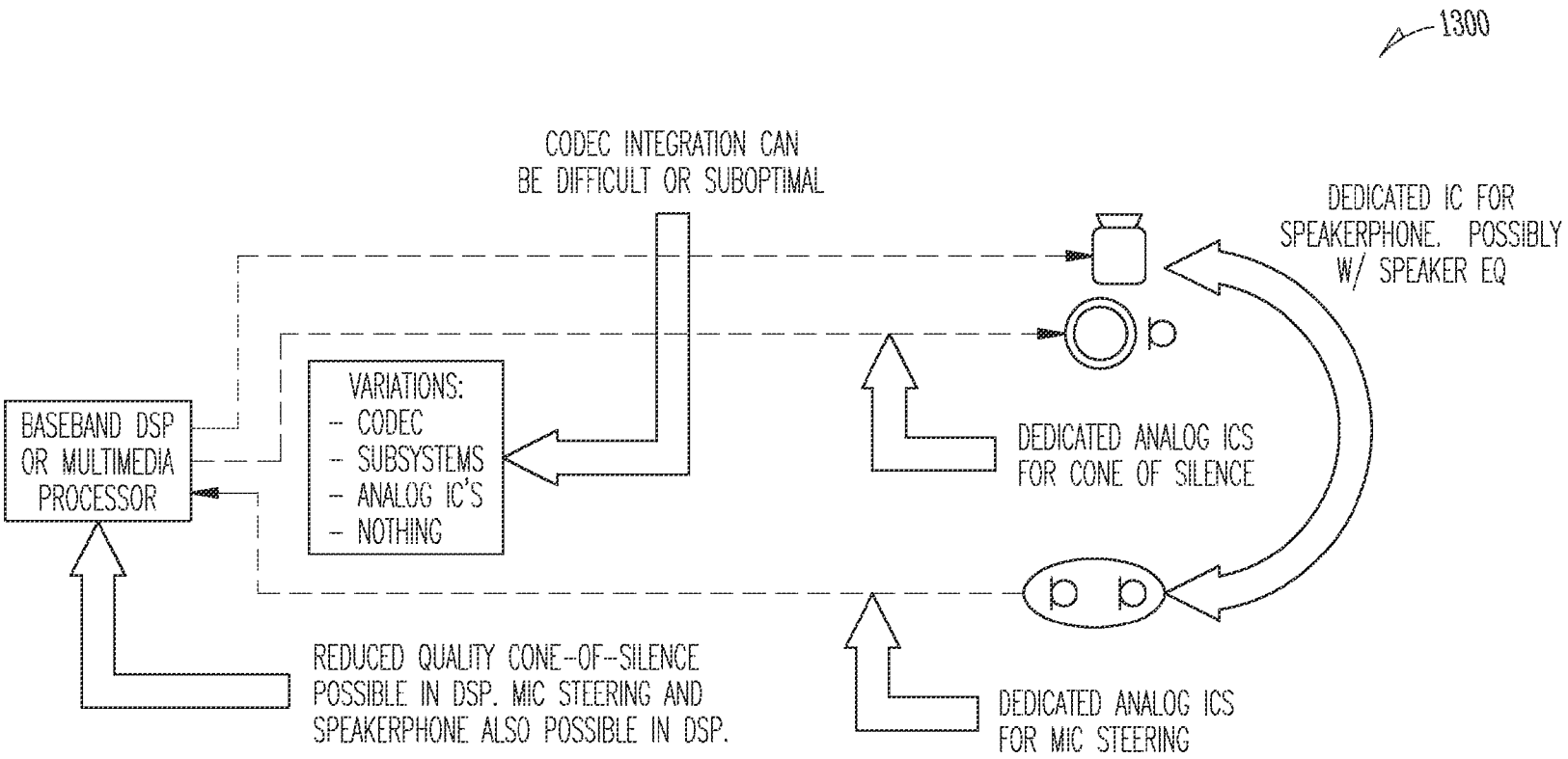
FIG. 13 illustrates generally an example of another ANC system.

FIG. 13 illustrates generally an example of another ANC system 1300.

Although the ANC systems and methods are described above with respect to a mobile phone, in other examples, the ANC systems and methods can be used with other electronic devices. For example, the ANC systems and methods can be used with headphones, car speakers, home speakers, non-mobile phones, speakerphones, and others. Additionally, the ANC systems and methods described above can be used in conjunction with other ANC systems and methods such as echo cancellation and others.

Additional Notes

The above detailed description includes references to the accompanying drawings, which form a part of the detailed description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. In other examples, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

The invention of claimed:

1. A system for providing active noise cancellation (ANC), comprising:

a digital ANC circuit configured to receive first audio information from a first microphone, to receive an intended audio signal, and to attenuate noise in the intended audio signal using the first audio information and provide a composite audio signal;

an analog ANC circuit configured to receive second audio information from a second microphone, to receive the composite audio signal from the digital ANC circuit, and to attenuate noise in the composite audio signal using the second audio information; and wherein the system is configured provide an output signal for a speaker using the digital ANC circuit and the analog ANC circuit.

2. The system of claim 1, wherein the first microphone includes a far-field microphone configured to sense ambient noise;

wherein the second microphone includes a near-field microphone configured to sense output from the speaker;

wherein the digital ANC circuit includes a digital feedforward ANC circuit; and wherein the analog ANC circuit includes an analog feedback ANC circuit.

3. The system of claim 1, including:

a first integrated circuit (IC) including the digital ANC circuit;

a second IC including; and wherein the first and second ICs combine to form a high-end product, in contrast to low-end product formed using only the second IC and not the first IC.

4. The system of claim 3, wherein the first IC is configured to be coupled to an analog to digital convert (ADC) to convert the first audio information to a digital signal for the digital ANC circuit.

5. The system of claim 1, wherein the system includes a digital to analog converter (DAC) configured to convert the composite audio signal into an analog signal for the analog ANC circuit; and wherein the analog ANC circuit includes an amplifier configured to receive the second audio information and the analog composite audio signal and to provide the output signal for the speaker.

6. The system of claim 5, wherein the digital ANC circuit and the DAC are implemented with a field programmable gate array (FPGA).

7. The system of claim 1, wherein the digital ANC circuit is configured to receive first audio information from a plurality of microphones, and wherein the digital ANC circuit includes a first filter coupled to a first subset of the plurality of microphones and a second filter coupled to a second subset of the plurality of microphones.

8. The system of claim 7, wherein each of the plurality of microphones has a separate filter associated therewith.

9. The system of claim 7, wherein the first filter and the second filter include an adaptive filter.

10. The system of claim 9, wherein the digital ANC uses the second audio information to update a response of the first and second filters.

11. The system of claim 7, wherein the digital ANC circuit is configured to adjust the first filter and the second filter to provide dynamic beamsteering for a sensing pattern of the first and second microphone.

12. The system of claim 1, wherein the speaker includes a piezoelectric speaker.

13. The system of claim 1, wherein the speaker includes a first piezoelectric speaker and a second dynamic speaker.

14. A method for providing active noise cancellation (ANC), comprising:

receiving first audio information from a first microphone and an intended audio signal attenuating noise in the intended audio signal, and providing a composite audio signal using a digital ANC circuit;

receiving second audio information from a second microphone and attenuating noise in the composite audio signal using an analog ANC circuit; and providing and output signal for a speaker using the digital ANC circuit and the analog ANC circuit.

15. The method of claim 14, wherein the first audio information is sensed by a first microphone configured to sense output from the speaker; and wherein the second audio information is sensed by a second microphone configured to sense ambient noise.

16. The method of claim 14, including adaptively filtering the second audio information.

17. The method of claim 16, wherein the adaptively filtering includes updating a filter response based on the first audio information.

18. The method of claim 14, wherein the receiving second audio information includes receiving second audio information from a plurality of microphones, wherein the method includes:

filtering a first signal from a third microphone of the plurality of microphones using a first filter; and filtering a second signal from a fourth microphone of the plurality of microphones using a second filter.

19. The method of claim 18, including adjusting the first filter and the second filter to provide dynamic beamsteering for a sensing pattern of the third and fourth microphone.

20. A system for providing active noise cancellation (ANC), comprising:

a digital ANC circuit configured to receive first audio information from a first microphone and to produce an anti-noise signal configured to attenuate noise sensed by the first audio information, wherein the digital ANC circuit includes:

a summation circuit configured to combine the anti-noise signal from the digital ANC circuit with an intended audio signal to form a composite audio signal; and an analog ANC circuit including an amplifier configured to receive second audio information from a second microphone and the composite audio signal, to attenuate noise in the second audio information, and to produce an output signal for a speaker based on the second audio information and the composite audio signal.

21. The system of claim 20, wherein the digital ANC circuit is configured to:

receive third audio information from a third microphone, the first and third microphones configured to sense ambient noise;

adaptively filter the first audio information with a first filter; and adaptively filter the third audio information with a second filter; and wherein the anti-noise signal is configured to attenuate noise in the third audio information.

22. The system of claim 21, wherein the digital ANC circuit is configured to dynamically adjust the first filter and the second filter to provide dynamic beamsteering for a sensing pattern of the first and second microphones.

* * * * *